US012753766B2

(12) United States Patent
Tilgner et al.

(10) Patent No.: US 12,753,766 B2
(45) Date of Patent: Oct. 6, 2026

(54) VERTICAL TURBINE PUMP AND METHOD FOR PRODUCING AN ELBOW HOUSING AND/OR A LANTERN HOUSING OF A VERTICAL TURBINE PUMP

(71) Applicant: WILO SE, Dortmund (DE)

(72) Inventors: Lukasz Tilgner, Dortmund (DE); Daniel Albers, Dortmund (DE); Raju Patil, Chinchwad (IN); Shashank Pawar, Chinchwad (IN); Alex Schewalje, Dortmund (DE)

(73) Assignee: WILO SE, Dortmund (DE)

( * ) Notice: Subject to any disclaimer, the term of this patent is extended or adjusted under 35 U.S.C. 154(b) by 5 days.

(21) Appl. No.: 18/782,810

(22) Filed: Jul. 24, 2024

(65) Prior Publication Data

US 2025/0035118 A1 Jan. 30, 2025

(30) Foreign Application Priority Data

Jul. 25, 2023 (BE) ..... 2023/5609

(51) Int. Cl.
*F04D 13/02* (2006.01)
*F04D 29/54* (2006.01)

(52) U.S. Cl.
CPC ..... *F04D 13/02* (2013.01); *F04D 29/548* (2013.01)

(58) Field of Classification Search
CPC ..... F04D 13/08; F04D 29/20; F04D 29/181; F04D 29/4293
USPC ..... 417/321, 423.3, 423.14, 424.1
See application file for complete search history.

(56) References Cited

U.S. PATENT DOCUMENTS 1,170,512 A * 2/1916 Chapman ..... F04D 13/02 417/423.12
1,745,547 A * 2/1930 Layne ..... F04D 29/606 417/423.12
2,023,039 A * 12/1935 Wells ..... F04D 13/02 417/364
2,250,306 A * 7/1941 La Bour ..... F04D 29/628 222/383.2
2,390,588 A * 12/1945 Heckman ..... F04D 25/02 417/423.15
2,483,335 A * 9/1949 Davis ..... F04D 1/14 415/218.1
2,491,751 A * 12/1949 Mcgee ..... F04D 29/042 415/135
2,801,083 A * 7/1957 Balassa ..... B01F 27/861 366/76.1
2,930,325 A * 3/1960 Peters ..... F04D 15/0218 417/423.15

(Continued)

FOREIGN PATENT DOCUMENTS

JP 2010174637 A 8/2010
WO WO 2023/034000 A1 3/2023

*Primary Examiner* — Benjamin Doyle
(74) *Attorney, Agent, or Firm* — Dority & Manning, P.A.

(57) ABSTRACT

The invention relates to a vertical turbine pump having a riser pipe extending along an axis, a motor shaft arranged in the riser pipe, an elbow housing with an elbow arranged therein and connected on a pressure side to the riser pipe, a lantern housing arranged on the elbow housing and accommodating the motor shaft, and a motor arranged on the lantern housing and driving the motor shaft, wherein the elbow housing and/or the lantern housing is formed mould-free and has a rectangular cross section.

17 Claims, 6 Drawing Sheets

(56) References Cited

U.S. PATENT DOCUMENTS 3,079,865 A * 3/1963 Lipe ..... F04D 29/628 415/201
3,482,520 A * 12/1969 Larsen ..... B01F 23/431 366/169.2
3,620,639 A * 11/1971 Gaffal ..... F04D 29/061 415/218.1
3,652,179 A * 3/1972 Hagen ..... F04D 29/648 415/176
3,733,151 A * 5/1973 Timmons ..... F04D 29/043 415/213.1
4,063,849 A * 12/1977 Modianos ..... F04D 29/445 415/218.1
4,073,606 A * 2/1978 Eller ..... F04D 29/044 415/124.2
4,230,144 A * 10/1980 Chalmers ..... G21C 13/024 137/343
4,417,850 A * 11/1983 Hacker ..... F04D 29/043 417/423.12
4,995,790 A * 2/1991 Schill ..... F04D 29/606 417/361
5,017,104 A 5/1991 Baker et al.
5,135,364 A * 8/1992 McEwen ..... B01D 21/0012 417/423.15
5,213,468 A * 5/1993 Sexton ..... F04D 29/061 277/411
5,332,373 A * 7/1994 Schendel ..... F04D 1/12 417/424.1
5,487,644 A * 1/1996 Ishigaki ..... F04D 1/04 415/206
5,496,150 A * 3/1996 Claxton, III ..... F04D 7/04 415/219.1
5,529,462 A * 6/1996 Hawes ..... F04D 29/406 417/361
5,788,466 A * 8/1998 Thompson ..... F04D 13/02 239/724
7,021,890 B2 * 4/2006 Ishigaki ..... F04D 29/2277 416/223 R
9,377,027 B2 * 6/2016 Behnke ..... F04D 1/006
2002/0164245 A1 * 11/2002 Okamura ..... F04D 29/4273 415/58.4
2009/0180874 A1 * 7/2009 Gutierrez ..... F04D 13/02 415/219.1
2010/0247340 A1 * 9/2010 Liang ..... F04D 29/4266 29/888.02
2010/0303646 A1 * 12/2010 Garrett ..... F04D 29/441 415/182.1
2011/0189036 A1 * 8/2011 Long ..... F04D 29/606 417/423.1
2012/0213632 A1 * 8/2012 Parry ..... F04D 29/026 415/208.1
2013/0260664 A1 * 10/2013 Morris ..... H05K 7/20909 361/695
2015/0098794 A1 * 4/2015 Baski ..... F04D 29/086 415/1
2016/0102668 A1 * 4/2016 Tivarovsky ..... F16M 11/20 417/423.15
2024/0093580 A1 * 3/2024 Albers ..... F16C 33/6659

* cited by examiner

VERTICAL TURBINE PUMP AND METHOD FOR PRODUCING AN ELBOW HOUSING AND/OR A LANTERN HOUSING OF A VERTICAL TURBINE PUMP

CROSS-REFERENCE TO RELATED APPLICATIONS

The present application is based upon and claims the right of priority to Belgian Patent Application No. 2023/5609, filed on Jul. 25, 2023, the disclosure of which is hereby incorporated by reference herein in its entirety for all purposes.

TECHNICAL FIELD

The invention relates to a vertical turbine pump with a riser pipe extending along an axis, a motor shaft arranged in the riser pipe, an elbow housing with an elbow arranged therein and connected on a pressure side to the riser pipe, a lantern housing arranged on the elbow housing and accommodating the motor shaft, and a motor arranged on the lantern housing and driving the motor shaft. The invention also relates to a method for producing an elbow housing for an elbow which may be arranged therein and connected on a pressure side to a riser pipe and/or a lantern housing for accommodating a motor shaft of a vertical turbine pump driveable by a motor, with the riser pipe extending along an axis and the motor shaft arranged in the riser pipe.

BACKGROUND OF THE INVENTION

Vertical turbine pumps, also known as vertical turbines, are semi-axial pumps intended to pump liquids, particularly from open liquid reservoirs, to a higher level. Vertical turbine pumps are used in all types of applications, from pumping process water in industrial plants to supplying cooling towers in power stations, from pumping raw water for irrigation to increasing water pressure in municipal pumping systems and for virtually any other conceivable pumping application. Vertical turbine pumps may achieve delivery heads of, for example, 40 to 100 metres by connecting several impellers in series.

Vertical turbine pumps generally comprise a motor mounted on some type of base or motor mount. A motor shaft may either be attached directly to the motor or coupled to it, and extends downwards towards the impeller through a column support or vertical pipe arrangement, also known as a riser pipe. The impeller routinely contains a plurality of impeller blades that rotate with the motor and the motor shaft, thus conveying the fluid into the riser pipe.

EP 2606238 A1 describes a vertical turbine pump, which is elongated in a longitudinal direction, with a motor and a motor shaft which is rotatably coupled to the motor and which drives an impeller. The fluid conveyed vertically upwards by the impeller into a riser pipe exits the riser pipe above a base plate through a tubular elbow in a horizontal direction.

In the embodiments known from the prior art, the elbow is provided in a cast-iron elbow housing, known as a 'delivery bend', which is arranged on the base plate in an axial extension of the riser pipe. A cast-iron lantern housing, also known as a motor support or, in combination with the delivery bend, as a DBMS housing, is provided on the elbow housing in an axial extension of the riser pipe, in which the motor shaft is arranged. Lastly, the motor, which is often very heavy, is provided axially on the lantern housing.

In this respect, in the case of the axially elongated DBMS housings known from the prior art, there is a considerable risk that the speed of the motor reaches the natural frequency of the aforementioned components and thus causes resonance, which may lead to vibrations and possible damage to the vertical turbine pumps.

DESCRIPTION OF THE INVENTION

Based on this situation, it is an object of the present invention to specify a vertical turbine pump and a corresponding production method for a vertical turbine pump in which the situation of resonance is avoided.

The object of the invention is achieved by the features of the independent claims. Advantageous embodiments are given in the dependent claims.

Accordingly, the object is achieved by a vertical turbine pump having

- a riser pipe extending along an axis,
- a motor shaft arranged in the riser pipe and, in particular, a motor shaft protection tube for the motor shaft,
- an elbow housing with an elbow arranged in it and connected on a pressure side to the riser pipe,
- a lantern housing arranged on the elbow housing and accommodating the motor shaft, and
- a motor arranged on the lantern housing and driving the motor shaft, wherein
- the elbow housing and/or the lantern housing is formed mould-free and has a rectangular cross section.

In the case of elbow housings and/or lantern housings known from the prior art, there is a not insignificant risk that the natural frequency of this structure may be affected during turbine pump operation in the event of an interaction between the rigidity of a structure formed by the elbow housing and/or the lantern housing and the mass of the engine, resulting in an undesirable situation of resonance that negatively affects the operation of the vertical turbine pump. This risk fundamentally results from the fact that the elbow housings and/or lantern housings known from the prior art do not have a rectangular structure but a round structure, which generally has a lower natural frequency than a rectangular structure.

In other words, the elbow housings and/or lantern housings known from the prior art, with a regular conical or round shape as a cast and/or welded construction with a minimum wall thickness due to the casting process and casting material used, allow only very limited control over material properties and little or no possibility of influencing the rigidity of the structure in order to shift the natural frequency into a range that is not critical for the operation of the vertical turbine pump.

The proposed solution takes a fundamentally different approach to the solutions known from the prior art, in which the elbow housing and/or the lantern housing is, on the one hand, formed mould-free, i.e. is made of rolled steel, for example, and, on the other hand, has a rectangle-like cross section, i.e. has a rectangular, square and/or box-shaped form, for example. The structure created in this way is stiffer than a cast, conical or round shape due to a higher modulus of elasticity, allows greater freedom of design, is more cost-effective, as standard or common steel profiles may be used to achieve the rectangular, square and/or box-shaped form, and also allows a more compact design, as a base of the elbow housing and/or the lantern housing is smaller and the elbow housing and/or the lantern housing may therefore be installed in more confined installation locations.

In summary, the proposed solution enables cost savings through weight reduction and the use of standard components without expensive casting tools, and, since the mechanical properties of rolled steel, for example, are significantly better than those of grey cast iron, an increase in the stiffness of the elbow housing and/or the lantern housing. By optimising the stiffness of the elbow housing and/or the lantern housing in this way, a significant shift in the natural frequency of the vertical turbine pump is achieved due to the use of thrust fields, which significantly reduces vibrations during operation and, as a result, potential destruction of the vertical turbine pump may be ruled out in principle.

To be formed mould-free means, in particular, that the elbow housing and/or the lantern housing is not primary moulded, i.e. in particular is not produced by means of a casting process, i.e. an initial mould of the elbow housing and/or the lantern housing is not produced directly from a liquid state, for example by means of a casting mould. In particular, being formed mould-free also means that the elbow housing and/or the lantern housing is not produced according to a production process in accordance with DIN 8580, i.e. not according to a production process in which a solid body with a geometrically defined shape is produced from a shapeless material. In other words, the expression "mould-free" means in particular that the direct starting materials for shaping the elbow housing and/or the lantern housing are not present in a liquid, gaseous, plastic, granular or powdery state. Preferably, the elbow housing and/or the lantern housing have a rectangular, square and/or aforementioned box-like shape, which defines the rectangular cross section in relation to the axis of the riser pipe. Unless otherwise defined, the terms axial and radial preferably refer to the axis of the riser pipe. The cross section preferably extends along the radial direction and/or the normal of the cross section runs parallel to the axis.

In particular, the elbow housing and/or the lantern housing provides a load-bearing function for the hydraulics and/or motor of the turbine pump, serves to guide the motor shaft, facilitates maintenance, etc. The stiffer and more robust the elbow housing and/or the lantern housing, the better that any vibrations occurring during operation of the turbine pump may be damped. Compared to a round or cylindrical structure, the proposed rectangular structure is stiffer and therefore less prone to vibration. The occurrence of resonance means in particular a shift of the first and second natural modes, which may coincide with an operating frequency of the turbine pump.

Vertical turbine pumps are semi-axial pumps configured to pump liquids, particularly from open liquid reservoirs, to a higher level. Vertical turbine pumps are often multi-stage, i.e. equipped with more than one impeller. However, they may also be single-stage, i.e. equipped with only one impeller. Each additional impeller increases the delivery head that the pump may generate at a constant flow rate. The outer diameter of the riser pipe may be as small as a few centimetres, so that the vertical turbine pump is 20 often much longer axially along the axis than it is radially wide. The riser pipe regularly extends largely below a base plate to which the vertical turbine pump may be attached. In this respect, the motor and the elbow are preferably arranged above the base plate in such a way that the riser pipe is connected just above or at the base plate, in particular fluid-tightly, to a first end of the elbow and the motor is arranged vertically above the elbow. The riser pipe is preferably made of metal and/or has a circular or circular-like cross section.

The motor shaft preferably extends in an axial direction along the centre line of the riser pipe and passes through the tubular elbow on an outer side in an axial extension of the riser pipe. On this outer side, an opening may be provided in the elbow through which the motor shaft passes. Preferably, a seal, in particular a radial seal, is provided, which is arranged in the opening and seals the motor shaft fluid-tightly in a radial circumferential manner with respect to the elbow. Preferably, the motor shaft ends in the lantern housing, in which a coupling may be arranged which may be connected between the motor and the motor shaft.

The elbow is preferably configured as a pipe bend or in pipe-bend-like manner and/or has a circular or elliptical shape when viewed from the side. The elbow preferably extends over an arc of a circle or an in a circular-arc-like manner over 90°, although other values such as 80° or 100° are also possible. Preferably, the elbow has a continuous curvature away from the axis, which in particular does not mean that the elbow initially extends in a direction opposite a second end of the elbow facing away from the riser pipe, for example has an S-shaped form, but instead extends linearly and/or continuously, in particular in a circular-arc-like or elliptical manner in side view, continuously further away from the axis or the riser pipe with respect to its radial centre line. Furthermore, the feature that the elbow has a curvature continuously away from the axis is to be understood in particular synonymously with the feature that the elbow extends continuously away from the axis with respect to its radial, in particular circular-arc-like, centre line. In the case of an elliptical shape extending in particular over 90°, the secondary axis of the ellipse preferably runs parallel to the axis and/or the main axis runs horizontally.

Preferably, a radial diameter relative to an axis of the elbow initially decreases as the height of the elbow from the first elbow end to the second elbow end and then increases, which means in particular that, at at least one position between the first elbow end and the second elbow end, the height of the elbow is less than the height at the first elbow end and/or at the second elbow end. In a side view, the elbow has a particularly 'flattened' shape. In particular, the elbow may again have a 'dented' shape on its outside when viewed from the side, wherein the height at the 'dent' is in particular reduced to a maximum. The radial diameter is understood in particular to be a radial inner diameter of the elbow in relation to the axis of the elbow, which defines a clear height in the elbow through which the fluid may flow. In this respect, when talking about a reduction or enlargement of the diameter, the outer diameter may also be meant in addition to the inner diameter.

According to a preferred further development, the elbow housing and/or the lantern housing is formed mould-free, in particular made of rolled steel, sheet metal and/or welded. For example, the elbow housing and/or the lantern housing may have four axially extending flat side walls, for example steel sheets, which are each welded with their opposite axial edges to an upper and lower, radially extending and in particular rectangular fastening plate with an opening. The elbow housing and/or the lantern housing is made in particular of metal, such as iron or aluminium. Welding allows particularly thin walls to be realised, which are around two to three times thinner than a cast construction. The elbow housing and the lantern housing may be formed in one piece as a single or common housing, i.e. not divided into two housings.

According to a further preferred embodiment, the elbow housing and/or the lantern housing has rolled, corner and/or angle profiles extending axially at its corners, in particular L-profiles, in particular triangular profiles in cross section, in particular as L-profiles closed with a diagonal sheet. A different type of angle profile may also be selected, depending on the desired rigidity behaviour of the angle profile. Axially and/or longitudinally extending corner and/or angle profiles may be used to transmit longitudinal forces that counteract bending moments. The angle profile is preferably configured as a straight, axially extending, extruded and/or thin-walled profile, for example as a tubular or channel profile, which may be welded to a flat steel sheet as a side wall without complex edge preparation for ease of manufacture. If, for example, an additional stiffening profile is required during operation of the vertical turbine pump in order to further increase rigidity, such an additional stiffening profile may simply be welded onto the mould-free elbow housing and/or lantern housing, in contrast to elbow housings and/or lantern housings known from the prior art with conically or cylindrically shaped and cast side walls. The angle profiles are preferably directed outwards, i.e. the legs of the angle profiles extend radially away from the axis in order to increase the shear and bending stiffness. L-profiles closed with a diagonal sheet provide high rigidity and are easy to produce.

According to another preferred development, the elbow housing and/or the lantern housing has at least two opposing, axially extending flat side walls. Such flat, in particular spaced-apart, rectangular and/or mutually parallel side walls allow a shear resistance to be utilised in order to effectively damp unwanted vibrations. The side walls may be arranged between two angle profiles provided at the corners and, in particular, welded to these and/or may extend over the entire axial extent of the angle profiles and/or between the fastening plates. In this way, the rigidity may be further increased, as the side walls serve as a so-called shear profile. In particular, a box-shaped elbow housing and/or lantern housing, preferably without curvatures, allows a high degree of rigidity.

According to a further preferred embodiment, a flat stiffening element extending axially and radially extends away from the side wall. The stiffening element may be profiled, rectangular and/or flat, in particular extending orthogonally away from the side wall and/or welded to it, and allows the natural frequency to be influenced favourably. Preferably, the stiffening element extends along the entire axial extent of the side wall, the angle profile, the elbow housing and/or the lantern housing and/or is connected to the fastening plates, in particular welded to them.

According to another preferred development, an opening is provided in the side wall. The opening may be configured as a recess in the side wall, so that the side wall extends, for example, only over part of the axial extent of the lantern housing and/or the lantern housing. The opening may be closed with a ventilation grille or the like and/or may be used for maintenance of the lantern housing and/or the lantern housing.

According to a further preferred embodiment, the elbow housing and the lantern housing and/or the lantern housing and the motor, in particular a motor housing of the motor, are screwed together, in particular screwed together at regular intervals and/or at the corners.

According to another preferred development, the elbow housing and/or the lantern housing has, at at least one axial end, in particular at both axial ends, a radially extending fastening plate, in particular in the form of a rectangular flange, in particular with a rectangular cross section.

Preferably, the elbow housing and the lantern housing and/or the lantern housing and the motor, in particular the motor housing of the motor, are connected to each other with screws passed through the respective fastening plates. A rectangular and/or mould-free base element is preferably provided, which also preferably has a respective radially extending fastening plate, in particular with a rectangular cross section, at both axial ends. The base element is preferably provided between the elbow housing and a base plate, preferably a base, wherein the base element is further preferably screwed to the elbow housing and/or the base plate by the respective fastening plate. The fastening plate preferably has a, in particular, rectangular or round opening through which, for example, the motor shaft is guided.

According to a further preferred embodiment, the elbow housing, the lantern housing and/or the motor is arranged in an axial extension of the riser pipe and/or the lantern housing is arranged in an axial extension of the riser pipe between the elbow housing and the motor. In other words, the motor is preferably arranged above the lantern housing and the lantern housing is preferably arranged above the elbow housing. According to another preferred development, the elbow housing and/or the lantern housing is box-shaped, in particular rectangular.

According to a further preferred embodiment, the vertical turbine pump has an impeller arranged at an opposite, lower end of the riser pipe and driven by the motor shaft for conveying a fluid into the riser pipe. The riser pipe and/or the vertical turbine pump preferably has an axial length of ≥10, 20, 30, 40 m or more. A plurality of impellers arranged axially one behind the other may be provided at the lower first end of the riser pipe, through which the fluid is conveyed into the riser pipe and axially upwards to the elbow. A second riser pipe end is preferably connected to the first elbow end fluid-tightly, in particular they are screwed together.

The problem is further solved by a method for producing an elbow housing for an elbow arrangeable therein and connectable on a pressure side to a riser pipe and/or for producing a lantern housing for accommodating a motor shaft of a vertical turbine pump driveable by a motor, with the riser pipe extending along an axis and the motor shaft arranged in the riser pipe, said method having the step of:

forming, in particular producing, the elbow housing and/or the lantern housing mould-free with a rectangular cross section.

According to a preferred embodiment, mould-free forming comprises producing from rolled steel, from sheet metal and/or by means of welding.

According to another preferred development, mould-free forming comprises welding of axially extending angle profiles, in particular L-profiles, in particular profiles of triangular cross section, provided at corners of the elbow housing and/or the lantern housing, to a radially extending fastening plate, in particular with a rectangular cross section, provided at at least one axial end, in particular at both axial ends, of the elbow housing and/or the lantern housing.

According to a further preferred embodiment, mould-free forming comprises providing at least two opposing, axially extending flat side walls.

According to another preferred development, mould-free forming comprises forming of the elbow housing and/or the lantern housing in a box shape.

Further advantages and embodiments of the method will become apparent to a person skilled in the art in analogy to the vertical turbine pump described above.

BRIEF DESCRIPTION OF THE DRAWINGS

In the following, the invention is explained in greater detail with reference to the appended drawings with reference to preferred exemplary embodiments.

In the drawings

DETAILED DESCRIPTION OF THE EXEMPLARY EMBODIMENTS

Figure 1:
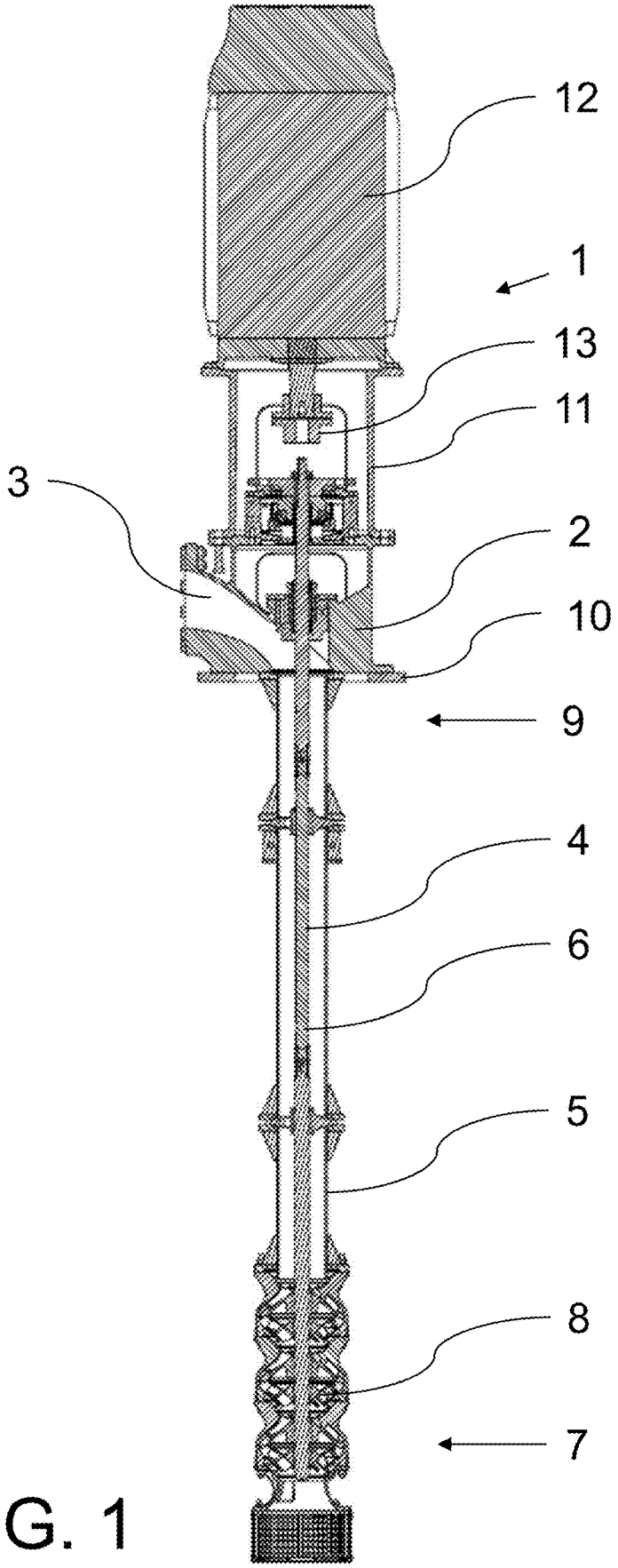
FIG. 1 shows a schematic sectional view of a vertical turbine pump with an elbow housing and a lantern housing according to a preferred exemplary embodiment of the invention.

FIG. 1 shows a schematic sectional view of a vertical turbine pump 1 with an abstractly drawn elbow housing 2 having an elbow 3 and an abstractly drawn lantern housing 11 according to a preferred exemplary embodiment of the invention.

The vertical turbine pump 1 has a riser pipe 5 extending along an axis 4 with a circular outer cross section, which has a plurality of interconnected segments. A motor shaft 6 extends in the centre of the metal riser pipe 5 along the axis 4 and along the entire length of the riser pipe 5 in such a way that a free space is formed radially around the motor shaft 6 between the latter and the riser pipe 5, through which free space the fluid conveyed by the vertical turbine pump 1 rises axially upwards. For this purpose, several impellers 8 arranged axially one above the other are provided at a lower riser pipe end 7 and are driven by the motor shaft 6, draw in the fluid, and convey it into the free space.

The upper end 9 of the riser pipe 5 is attached to a base plate 10, so that the riser pipe 5 extends vertically downwards away from the base plate 10. Above the base plate 10, the elbow housing 2 adjoins vertically or upwards in the direction of the axis 4, initially in contact with the base plate, and in turn is adjoined by the lantern housing 11 in axial contact, and lastly by a motor 12 driving the motor shaft 6 and provided in a motor housing. A coupling 13 is arranged in the lantern housing 11 and is connected between the motor 12 and the motor shaft 6. Accordingly, the motor shaft 6 ends in the lantern housing 11. The elbow housing 2 and the lantern housing 11 are configured in two parts and are screwed together, as described below. The riser pipe upper end 9 is connected fluid-tightly to a first elbow end of the elbow 3 facing the impeller 8.

Figure 2:
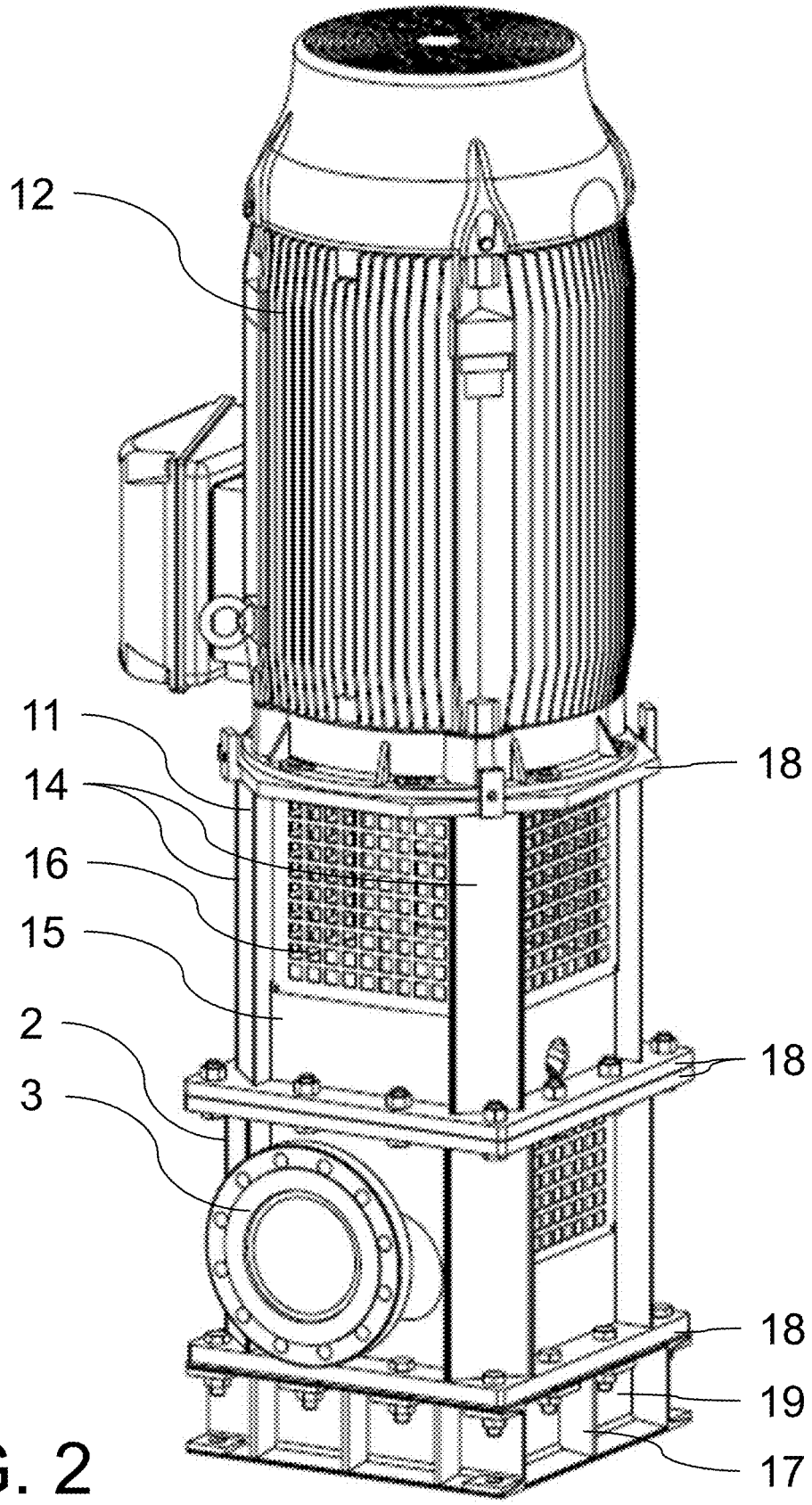
FIG. 2 shows a schematic perspective view of the elbow housing and the lantern housing of the vertical turbine pump according to FIG. 1 in accordance with the preferred exemplary embodiment of the invention.
Figure 3:
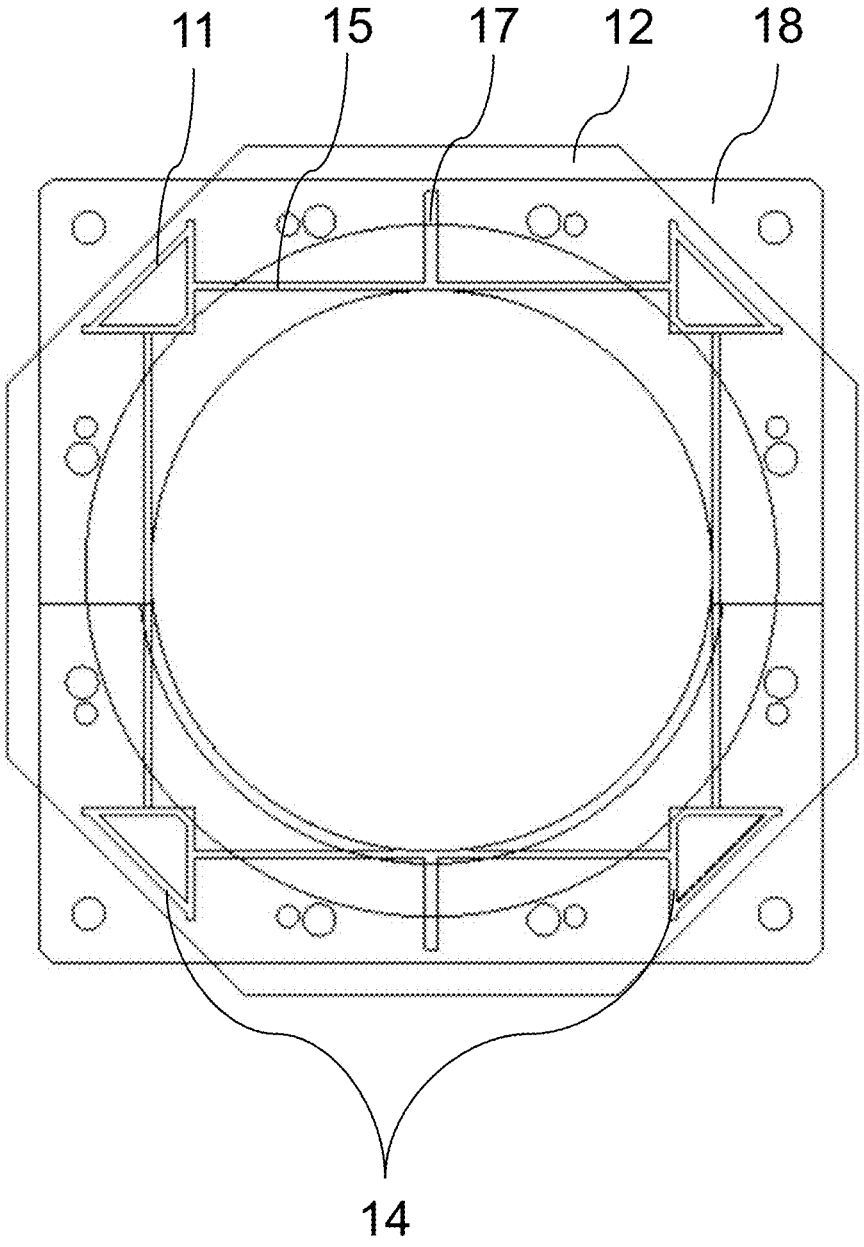
FIG. 3 shows a schematic transparent plan view of the lantern housing of the vertical turbine pump according to FIG. 1 according to a further preferred exemplary embodiment of the invention.

Referring now to FIG. 2, which shows a schematic perspective view of the elbow housing 2 and the lantern housing 11 of the vertical turbine pump 1 according to FIG. 1 in accordance with the preferred exemplary embodiment of the invention, and to FIG. 3, which shows a schematic sectional view of a plan view of the lantern housing 11 of the vertical turbine pump 1 according to FIG. 1 in accordance with a further preferred exemplary embodiment of the invention slightly supplemented with respect to FIG. 2, both the elbow housing 2 and the lantern housing 11 are produced mould-free, i.e. from welded-together metal sheets of rolled steel and profiles, and both the elbow housing 2 and the lantern housing 11 have a rectangular cross section in plan view.

Specifically, the elbow housing 2 and the lantern housing 11 each have four corners of axially extending, spaced-apart angle profiles 14 at their corners, which are configured as outwardly open L-profiles and are each closed, i.e. triangular in cross section, as may be seen in particular from FIG. 3 (FIG. 1 does not show the L-profiles). Axially extending flat side walls 15 made of sheet metal, which are welded to the angle profiles 14, are provided between two adjacent angle profiles 14.

The four side walls 15 extend, at least on the lantern housing 11, only along one part of the axial extent of the angle profiles 14, wherein an opening 16 is provided in the other part for maintenance of the lantern housing 11, which opening 16 is covered by a removable grille. The elbow housing 2 also has four side walls 15, wherein one side wall is closed insofar as the elbow 3 passes through this side wall 15 shown in the front left of the figure. In the embodiment shown in FIG. 3, the two side walls 15 shown at the top and bottom in the figure are provided with a flat, axially and radially extending rectangular stiffening element 17 made of sheet metal, which is welded along an axial edge to the corresponding side wall 15.

Returning to FIG. 2, the elbow housing 2 has a radially extending fastening plate 18 with a rectangular cross section at each of its two axial ends, which fastening plate, as may be seen from FIG. 3 for the lantern housing 11, is provided with a circular opening enclosed by the side walls 15 for the riser pipe 5 to pass through. At its lower axial end, the lantern housing 11 also has such a fastening plate 18, which is configured or arranged congruently with and in contact with the upper fastening plate 18 of the elbow housing 2. At its upper axial end, the lantern housing 11 has an octagonal fastening plate 18, which lies in contact with a circular base of the engine housing. In this respect, the respective fastening plates 18 extend orthogonally to the side walls 15 and are welded to these as well as to the angle profiles 14.

Axially below the elbow housing 2, a base element 19 is provided which is also formed mould-free and in a box shape, and which also has a fastening plate 18 at its lower axial ends. At its upper axial end, the base element 19 is formed and arranged congruently with and in contact with the lower fastening plate 18 of the elbow housing 2. Like the lantern housing 11 of FIG. 3, the base element 19 is also provided with axially and radially extending rectangular stiffening elements 17 made of sheet metal.

The base element 19 is fastened to a base with its fastening plate 18, not shown. The elbow housing 2 placed axially on the base element 19 is fastened to the base element 19 with screws guided through the lower fastening plate 18 of the elbow housing 2, wherein the screws are provided at regular intervals on the one hand and at the corners of the fastening plate 18 on the other. The lantern housing 11 placed axially on the elbow housing 2 is also fastened by screws guided through the respective fastening plates 18, wherein the screws again are provided at regular intervals on the one hand and at the corners of the fastening plate 18 on the other. Lastly, the motor housing of the motor 12, which is mounted axially on the lantern housing 11, is also connected by screws guided through the octagonal fastening plate 18 of the lantern housing 11 and the circular base of the motor housing.

Figure 4:
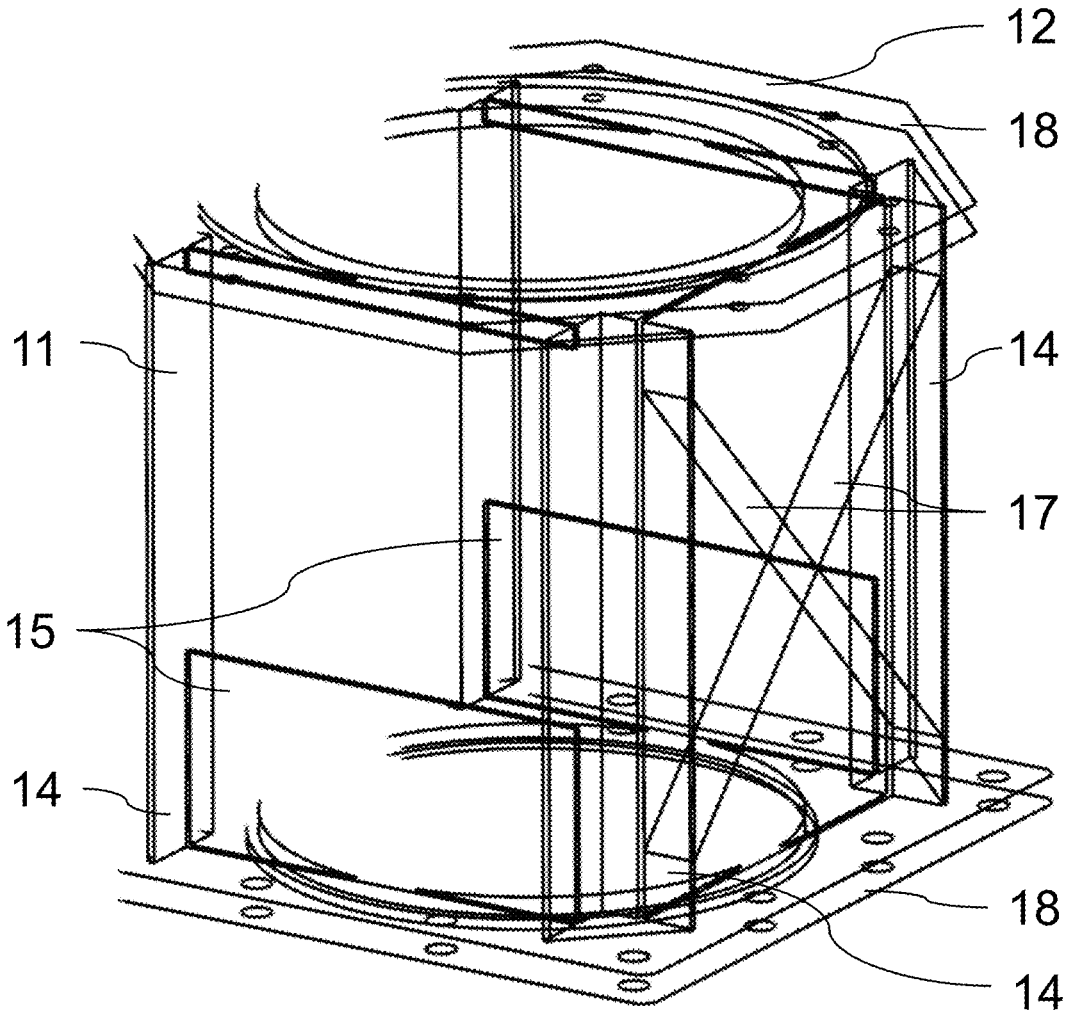
FIG. 4 shows a schematic perspective view of the lantern housing of the vertical turbine pump according to FIG. 1 according to a yet further preferred exemplary embodiment of the invention.
Figure 5:
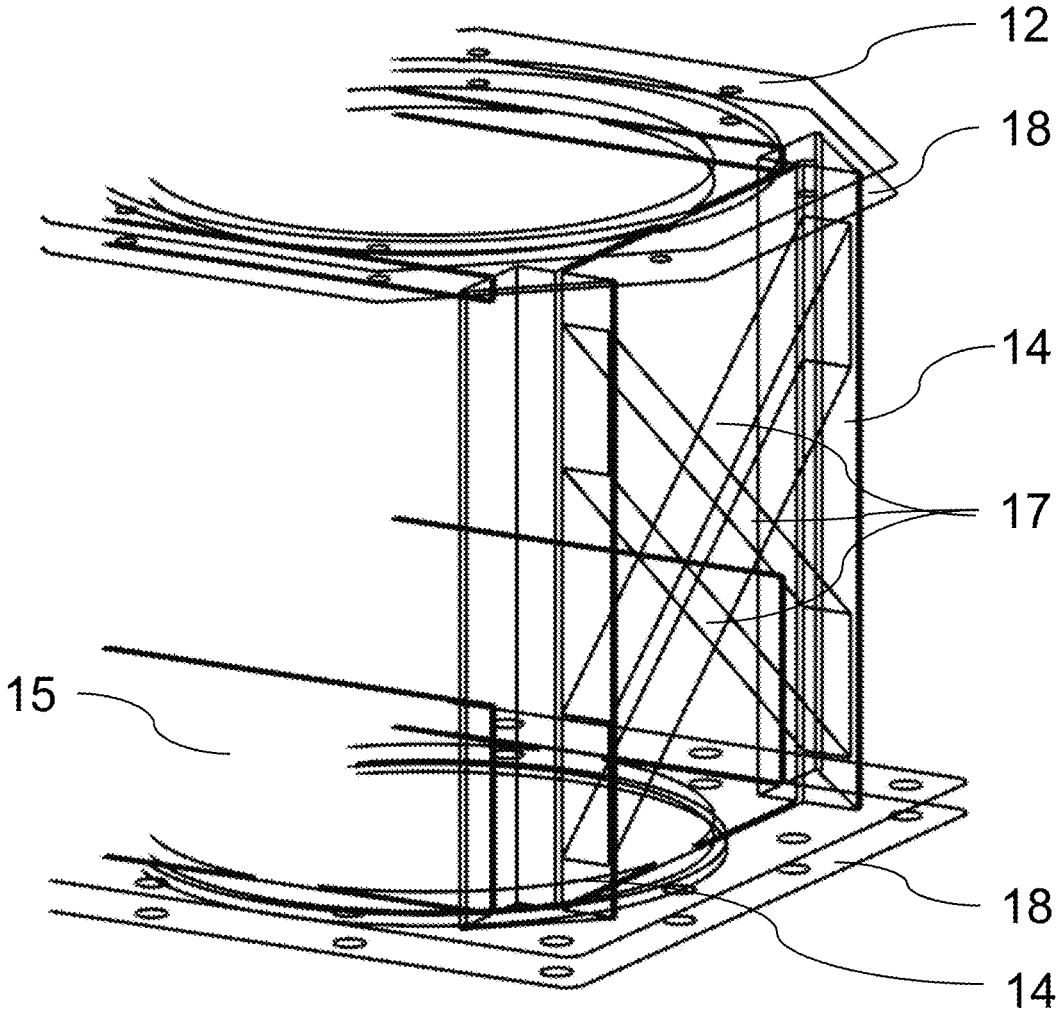
FIG. 5 shows a schematic perspective view of the lantern housing of the vertical turbine pump according to FIG. 1 according to a yet further preferred exemplary embodiment of the invention.
Figure 6:
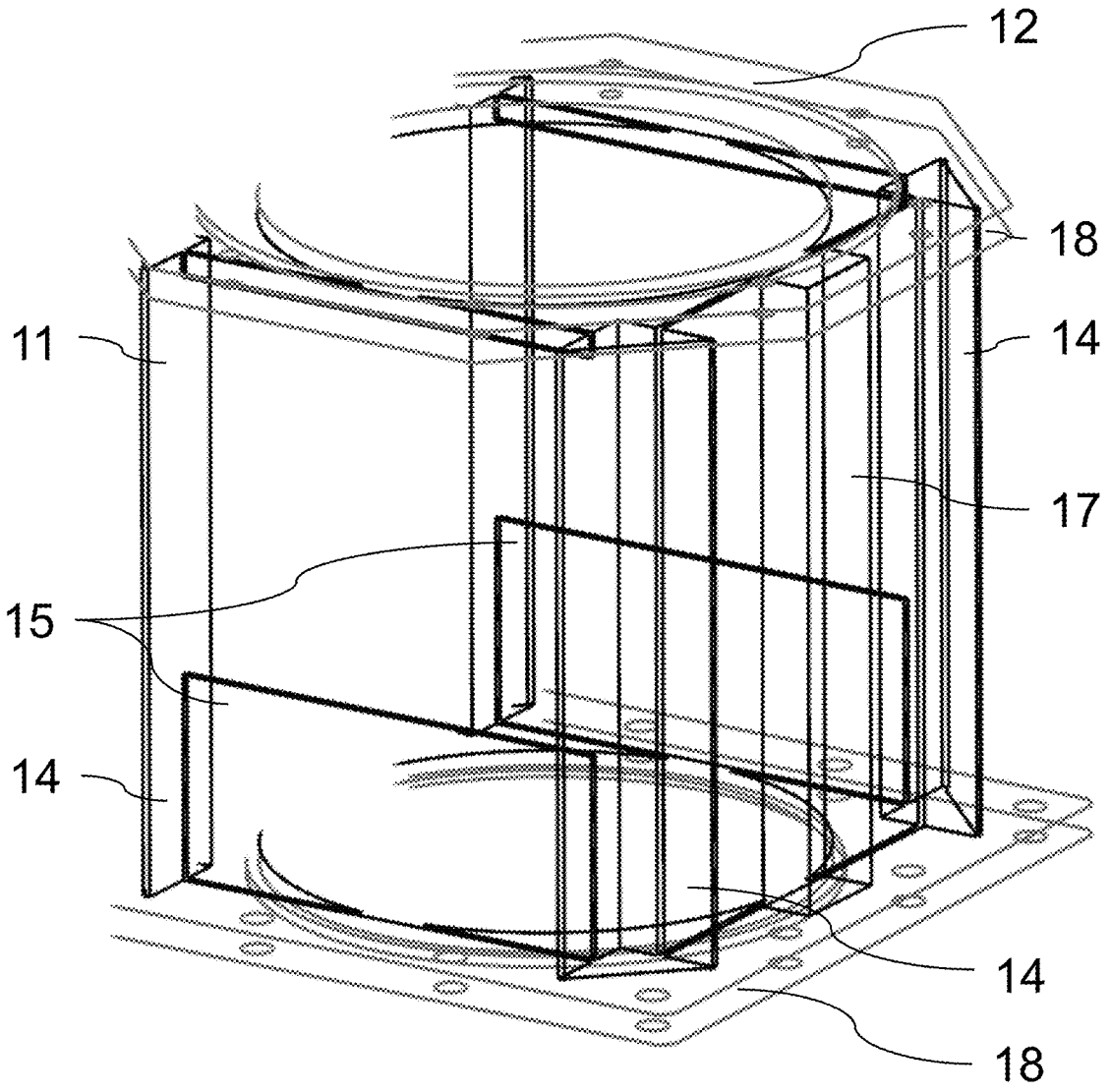
FIG. 6 shows a schematic perspective view of the lantern housing of the vertical turbine pump according to FIG. 1 according to a yet further preferred exemplary embodiment of the invention.

FIGS. 4 to 6 each show a schematic perspective view of the lantern housing 11 of the vertical turbine pump 1 according to FIG. 1 according to a further preferred exemplary embodiment of the invention and with a respective stiffening element 17. In the exemplary embodiment of FIG. 4, two crossed sheet metal strips are welded onto the side wall 15 as stiffening elements 17. Of the two struts of the stiffening elements 17, one strut extends diagonally between the two oppositely arranged fastening plates 18 and the oppositely arranged angle profiles 14, while the other strut is welded diagonally to the first strut and in two parts at the respective ends to the centre of the continuous strut.

FIG. 5 shows a similar design, but with four struts as stiffening elements 17, which are configured as crossed U-profiles. In each case, two struts extend parallel to the two remaining struts, which also extend parallel to each other. The rectangular struts are each welded to the side wall 15 along their longitudinal edges, while the transverse edges are welded to the angle profiles 14. Lastly, FIG. 6 shows an axially extending stiffening element 17, which has a U-shaped form in axial section, the edges of which are welded to the side wall 15 and to the opposing fastening plates 18.

The described exemplary embodiments are merely examples that may be modified and/or supplemented in a variety of ways within the scope of the claims. Each feature described for a particular exemplary embodiment may be used independently or in combination with other features in any other exemplary embodiment. Each feature described for an exemplary embodiment of a certain category may also be used in a corresponding manner in an exemplary embodiment of another category.

LIST OF REFERENCE SIGNS vertical turbine pump 1
elbow housing 2
elbow 3
axis 4
riser pipe 5
motor shaft 6
riser pipe lower end 7
impeller 8
riser pipe upper end 9
base plate 10
lantern housing 11
motor 12
coupling 13
angle profile 14
side wall 15
opening 16
stiffening element 17
fastening plate 18
floor element 19

The invention claimed is:

1. A vertical turbine pump, comprising:
a riser pipe extending along an axis,
a motor shaft arranged in the riser pipe,
an elbow housing with an elbow arranged therein and connected on a pressure side to the riser pipe,
a lantern housing arranged on the elbow housing and accommodating the motor shaft, and
a motor arranged on the lantern housing and driving the motor shaft, wherein
at least one of the elbow housing and the lantern housing is formed mould-free and is box-shaped having at least two opposing, axially extending flat side walls defining a rectangular cross section.

2. The vertical turbine pump according to claim 1, wherein at least one of the elbow housing and the lantern housing is formed mould-free from rolled steel, formed mould-free from sheet metal, or welded.

3. The vertical turbine pump according to claim 1, wherein at least one of the elbow housing and the lantern housing has, at its corners, axially extending angle profiles.

4. The vertical turbine pump according to claim 3, wherein the axially extending angle profiles comprise L-profiles or profiles of triangular cross section.

5. The vertical turbine pump according to claim 1, wherein an axially and radially extending flat stiffening element extends away from the side wall.

6. The vertical turbine pump according to claim 1, wherein an opening is provided in the side wall.

7. The vertical turbine pump according to claim 1, wherein at least one of the elbow housing and the lantern housing and the lantern housing and the motor are screwed together, screwed together at regular intervals, or screwed together at the corners.

8. The vertical turbine pump according to claim 1, wherein at least one of the elbow housing and the lantern housing has a radially extending fastening plate at an at least one axial end.

9. The vertical turbine pump according to claim 8, wherein the radially extending fastening plate has a rectangular cross section.

10. The vertical turbine pump according to claim 1, wherein at least one of the elbow housing and the lantern housing has a first radially extending fastening plate and a second radially extending fastening plate arranged at both first and second axial ends, of either the elbow housing and the lantern housing.

11. The vertical turbine pump according to claim 1, wherein the elbow housing, the lantern housing, or the motor is arranged in axial extension of the riser pipe.

12. The vertical turbine pump according to claim 1, wherein the lantern housing is arranged in axial extension of the riser pipe between the elbow housing and the motor.

13. The vertical turbine pump according to claim 1, wherein the elbow housing or the lantern housing is box-shaped.

14. The vertical turbine pump according to claim 1, comprising an impeller arranged at an opposite, lower riser end and driven by the motor shaft for conveying a fluid into the riser pipe.

15. A method for producing at least one of an elbow housing for an elbow arranged therein and connected on a pressure side to a riser pipe and a lantern housing accommodating a motor shaft, driven by a motor, of a vertical turbine pump with the riser pipe extending along an axis and the motor shaft arranged in the riser pipe, said method having the step of:
forming at least one of the elbow housing and the lantern housing of the vertical turbine pump mould-free with a box shape having at least two opposing, axially extending flat side walls defining a rectangular cross section.

16. The method according to claim 15, wherein mould-free forming comprises producing from rolled steel, from sheet metal, or by means of welding.

17. The method according to claim 15, wherein mould-free forming comprises welding of axially extending angle profiles provided at corners of at least one of the elbow housing and/or and the lantern housing to a radially extending fastening plate provided at an at least one axial end of the at least one of the elbow housing and the lantern housing.

* * * * *